US010453341B2

(12) United States Patent
Guseynov et al.

(10) Patent No.: US 10,453,341 B2
(45) Date of Patent: Oct. 22, 2019

(54) SYSTEM AND METHOD FOR DETERMINING PARKING AVAILABILITY

(71) Applicant: YANDEX EUROPE AG, Lucerne (CH)

(72) Inventors: Aleksey Timurovich Guseynov, Moscow (RU); Yury Sergeevich Kirpichev, Moscow (RU); Ivan Mikhailovich Seleznev, Moscow (RU)

(73) Assignee: YANDEX EUROPE AG, Lucerne (CH)

( * ) Notice: Subject to any disclaimer, the term of this patent is extended or adjusted under 35 U.S.C. 154(b) by 0 days.

(21) Appl. No.: 15/977,070

(22) Filed: May 11, 2018

(65) Prior Publication Data

US 2019/0139410 A1 May 9, 2019

(30) Foreign Application Priority Data

Nov. 7, 2017 (RU) ..... 2017138515

(51) Int. Cl.
*G08G 1/14* (2006.01)
*G08G 1/01* (2006.01)

(52) U.S. Cl.
CPC ..... *G08G 1/144* (2013.01); *G08G 1/012* (2013.01); *G08G 1/0112* (2013.01); *G08G 1/0133* (2013.01); *G08G 1/0141* (2013.01)

(58) Field of Classification Search
CPC ..... G08G 1/144
See application file for complete search history.

(56) References Cited

U.S. PATENT DOCUMENTS

| | | | | |
|---|---|---|---|---|
| 8,576,092 | B2 | 11/2013 | Levy et al. | |
| 9,177,475 | B2 | 11/2015 | Sellschopp | |
| 9,472,101 | B2 | 10/2016 | Schulz et al. | |
| 9,672,741 | B2 | 6/2017 | Scofield | |
| 2013/0290045 | A1 | 10/2013 | Levy et al. | |
| 2015/0161890 | A1* | 6/2015 | Huntzicker | G08G 1/144 340/932.2 |
| 2015/0279213 | A1 | 10/2015 | Balter et al. | |

OTHER PUBLICATIONS

Caicedo et al., "Prediction of parking space availability in real time", vol. 39, Issue 8, 2012, Abstract, https://www.sciencedirect.com/science/article/pii/S0957417412001042.
Pullola et al., "Towards an Intelligent GPS-Based Vehicle Navigation System for Finding Street Parking Lots", Research Gate, Conference Paper, 2007, 4 pages, https://www.researchgate.net/publication/224363474.
Nandugudi et al., "PocketParker: Pocketsourcing Parking Lot Availability", UBICOMP '14, 2014, USA, pp. 963-973.

* cited by examiner

*Primary Examiner* — Quan-Zhen Wang
*Assistant Examiner* — Rajsheed O Black-Childress
(74) *Attorney, Agent, or Firm* — BCF LLP

(57) ABSTRACT

Disclosed are systems and methods for determining whether a user of a navigation software or service has left a parking space and hence the parking space may have a potentially free space. The described technique provides other users of the navigation service with an indication of a potentially available parking space at the recently departed place. More specifically, the described technique involves calculating probabilities for a particular user to be leaving a specific parking space from a plurality of parking spaces nearby to the user's location.

15 Claims, 7 Drawing Sheets

SYSTEM AND METHOD FOR DETERMINING PARKING AVAILABILITY

CROSS-REFERENCE

The present application claims priority to Russian Patent Application No. 2017138515, entitled "System and Method for Determining Parking Availability", filed Nov. 7, 2017, the entirety of which is incorporated herein by reference.

FIELD OF TECHNOLOGY

The present disclosure relates generally to the field of detecting parking availability, more specifically, to systems and methods of detecting parking availability of individual parking spaces using a probabilistic analysis of predetermined parking lots.

BACKGROUND

Many electronic devices available to a user provide geo-location and routing information. Some of these electronic devices are dedicated to provision of the geo-location and routing information. An example of such devices would be a portable GPS navigator, such as those available from TomTom Corporation of Amsterdam, The Netherlands. Another example of such devices would be a GPS navigator, built-in into a car. For example, many car manufacturers provide an option to include a built-in navigation system into their cars. Other electronic devices provide geo-location and route information as an add-on to other functions. For example, most smartphones available on the market today include an application that provides geo-location and routing services.

Some geo-location and routing services provide locations of known parking lots and garages, and/or notations for street parking having certain time-based or use-based restrictions (e.g., no standing, commercial vehicles only, from 8:00 AM to 5:00 PM). However, a driver navigating to those locations will likely find closed or occupied parking spaces, as such services fail to indicate to a driver where available parking spaces are located in reality.

Some approaches for advertising which parking spaces are becoming free involve parking lots that are outfitted with dedicated sensors to determine whether respective parking places is available or occupied. This data can be assembled in a central control device, so that the control device can control a parking guidance system in such a way that a vehicle arriving in the parking lot quickly finds a parking place. However, this approach is costly, as dedicated hardware devices must be installed in each parking lot that seeks to support the parking guidance system.

In another approach, automobiles may be outfitted with sensors that recognize when a parking place is potentially becoming free. For example, an automobile may have optical image sensor that verifies, while the automobile is driving along a row of cars, whether any cars within the row has lights on, or a thermal sensor to determine whether a car in the row of cars has a warm (running) engine or a cold engine, etc. However, this approach is limited in range, and applies only to those parking places proximate to the car (i.e., within range of the sensors), and is unable to find free parking places even one block away, let alone, in advance of reaching a future destination.

Other approaches include smartphone applications which volunteer parking spots to a central server, such as ParkMe™ or Google® Open Spot. Such approaches have required that the user leaving their parking spot to expressly report, via the smartphone application, the parking spot will be free. This requirement for an express user action increases the friction of the user experience (e.g., users may forget, or be distracted) and reduces the likelihood that a substantial number of parking places will be reported. Furthermore, such systems can suffer from inaccuracies in location data depending on the timing of the volunteer report (i.e., a user may report their location well after they have departed the actual parking spot) or stemming from GPS-based inaccuracies from signal interference. Considering that a parking spot typically has a size of 9 feet wide by 18 feet long, parking data that is off by as little as 50 feet to 100 feet could mean the other side of a two-way street, another block, or even a neighboring garage complex.

SUMMARY

As such, a system and method is disclosed herein for detecting parking availability of individual parking spaces using a probabilistic analysis of predetermined parking lots. Aspects of the present disclosure provide a method for determining whether a user of a navigation software or service (or simply a driver using a device) has left a parking space and hence the parking space may have a potentially free space. Furthermore, the described technology provides other users of the navigation service with an indication of a potentially available parking space at the recently abandoned place. More specifically, the described technique relates to calculating probabilities that a particular user will leave a specific parking space from a plurality of parking spaces nearby to the user's location. The described technique further addresses the problem of having only an approximate or vague position of the user, which can occur when a user activates their navigation software only after they leave their parking space, or which may occur due to GPS-based location issues. Other approaches have used aggregated statistics to determine the likelihood of available parking in a general area due to the noise in GPS data and difficulty in determining an exact parking space that is free. In contrast, aspects of the present disclosure may advantageously associate a user's initially detected location with a specific parking place from a plurality of parking places within a distance range.

According to one exemplary aspect, a computer-implemented method for managing vehicle parking availability is provided. The method includes receiving, from a device, an indication of a transportation-behavior change associated with a first user. The indication of the transportation-behavior change specifies a change from a first transportation behavior to a second transportation behavior at a first location. The method further includes identifying, using records of parking spaces stored in a database, an available parking space based on the received indication of the transportation-behavior change, determining one or more navigation users having a destination proximate to the available parking space, calculating, for each navigation user, a parking-availability probability that the respective navigation user will obtain the available parking space, and transmitting, to at least one of the navigation users, a notification of the available parking space according to the calculated parking-availability probabilities.

According to another aspect, the identifying the first parking space has become available based on the received indication of the transportation-behavior change further includes identifying one or more candidate parking spaces based on the location of the transportation-behavior change associated with the user of the device, calculating a set of second probabilities associated with the candidate parking spaces, each probability of the set of second probabilities specifying a confidence level that the location of the transportation-behavior change is located at a respective candidate parking space, and identifying the available parking space associated with the transportation-behavior change based on a calculated maximal probability of the set of second probabilities.

According to any of the aforementioned aspects, calculating the set of second probabilities associated with the candidate parking spaces is based on at least one of a set of factors including a size of a parking lot, a distance of a parking space to the location of the transportation-behavior change, a type of parking, a number of times other users that have been associated with the parking space, and a number of previously-recorded locations have been associated with the respective parking space in a prior time period.

According to any of the aforementioned aspects, the method further includes calculating a cumulative probability based on at least one from the set of second probabilities associated with a first parking place and on at least one from the set of parking-availability probabilities associated with a navigation user, wherein the cumulative probability represents a likelihood that the first parking space is available and that the navigation user will obtain the first parking space.

According to any of the aforementioned aspects, transmitting, to at least one of the navigation users, the notification of the available parking space according to the calculated parking-availability probabilities further comprises: selecting a subset of the navigation users having an associated parking-availability probability of obtaining the available parking space that exceeds a first threshold value, and transmitting the notification to the selected subset.

According to any of the aforementioned aspects, the transmitting, to at least one of the navigation users, the notification of the available parking space according to the calculated parking-availability probabilities further includes ranking the navigation users according to the associated parking-availability probability of obtaining the available parking space; and transmitting the notification to a subset of the ranked navigation users.

According to another exemplary aspect, a computer-implemented method for determining vehicle parking availability is provided. The method includes receiving, from a device, an indication of a transportation-behavior change associated with a user of the device. The indication of the transportation-behavior change specifies a change from a first transportation behavior of the user to a second transportation behavior of the user at a location. The method further includes identifying one or more candidate parking spaces based on the location of the transportation-behavior change associated with the user of the device, and calculating a set of probabilities associated with the candidate parking spaces, each probability of the set of probabilities specifying a confidence level that the location of the transportation-behavior change is located at a respective candidate parking space. The method further includes determining an available parking space associated with the transportation-behavior change based on a calculated maximal probability of the set of probabilities, and transmitting notification of the available parking space to other devices.

According to any of the aforementioned aspects, identifying the one or more candidate parking spaces includes determining a map section associated with the location of the transportation-behavior change, and identifying the candidate parking spaces contained within the map section.

According to any of the aforementioned aspects, the transportation-behavior change is determined based on a behavior pattern of a plurality of predetermined behavior patterns.

According to any of the aforementioned aspects, the transportation-behavior change specifies a change from a first transportation behavior of walking to a second transportation behavior of driving.

According to any of the aforementioned aspects, the method further includes determining the location of the transportation-behavior change to be within a predetermined area threshold of at least one of previous device-associated location, and responsive to determining that the location is out of the predetermined area threshold, adjusting the location of the transportation-behavior change with the at least one of previous device-associated locations.

According to any of the aforementioned aspects, calculating the set of probabilities associated with the candidate parking spaces is based on at least one of a set of factors including a size of a parking lot, a distance of a parking space to the location of the transportation-behavior change, a type of parking, a number of times other users have been associated with the parking space, and a number of previously-recorded locations have been associated with the respective parking space in a prior time period.

According to any of the aforementioned aspects, transmitting notification of the available parking space to the other devices includes identifying a set of the other devices having routes with a destination proximate to the location of the available parking space, and transmitting the notification to the identified other devices.

According to another exemplary aspect, a system for determining vehicle parking availability is provided. The system includes a hardware processor configured to: receive, from a device, an indication of a transportation-behavior change associated with a user of the device, wherein the indication of the transportation-behavior change specifies a change from a first transportation behavior of the user to a second transportation behavior of the user at a location; identify one or more candidate parking spaces based on the location of the transportation-behavior change associated with the user of the device; calculate a set of probabilities associated with the candidate parking spaces, each probability of the set of probabilities specifying a confidence level that the location of the transportation-behavior change is located at a respective candidate parking space; determine an available parking space associated with the transportation-behavior change based on a calculated maximal probability of the set of probabilities; and transmit notification of the available parking space to other devices.

According to any of the aforementioned aspects, the processor configured to identify the one or more candidate parking spaces is further configured to: determine a map section associated with the location of the transportation-behavior change; and identify the candidate parking spaces contained within the map section.

According to any of the aforementioned aspects, the transportation-behavior change is determined based on a behavior pattern of a plurality of predetermined behavior patterns.

According to any of the aforementioned aspects, the transportation-behavior change specifies a change from a first transportation behavior of walking to a second transportation behavior of driving.

According to any of the aforementioned aspects, the processor is further configured to: determine the location of the transportation-behavior change to be within a predetermined area threshold of at least one of previous device-associated locations; and responsive to determining that the location is out of the predetermined area threshold, adjust the location of the transportation-behavior change with the at least one of previous device-associated locations.

According to any of the aforementioned aspects, the processor is configured to calculate the set of probabilities associated with the candidate parking spaces based on at least one of a set of factors including a size of a parking lot, a distance of a parking space to the location of the transportation-behavior change, a type of parking, a number of times other users have been associated with the parking space, and a number of previously-recorded locations have been associated with the respective parking space in a prior time period.

According to any of the aforementioned aspects, the processor configured to transmit the notification of the available parking space to the other devices is further configured to: identify a set of the other devices having routes with a destination proximate to the location of the available parking space; and transmit the notification to the identified other devices.

According to another exemplary aspect, a system is provided comprising a hardware processor configured to performing any of the methods disclosed herein.

According to another exemplary aspect, a computer-readable medium is provided comprising instructions that comprises computer executable instructions for performing any of the methods disclosed herein.

The above simplified summary of example aspects serves to provide a basic understanding of the present disclosure. This summary is not an extensive overview of all contemplated aspects, and is intended to neither identify key or critical elements of all aspects nor delineate the scope of any or all aspects of the present disclosure. Its sole purpose is to present one or more aspects in a simplified form as a prelude to the more detailed description of the disclosure that follows. To the accomplishment of the foregoing, the one or more aspects of the present disclosure include the features described and exemplarily pointed out in the claims.

BRIEF DESCRIPTION OF THE DRAWINGS

The accompanying drawings, which are incorporated into and constitute a part of this specification, illustrate one or more example aspects of the present disclosure and, together with the detailed description, serve to explain their principles and implementations.

DETAILED DESCRIPTION

Exemplary aspects are described herein in the context of a system, method, and computer program product for determining vehicle parking availability. Those of ordinary skill in the art will realize that the following description is illustrative only and is not intended to be in any way limiting. Other aspects will readily suggest themselves to those skilled in the art having the benefit of this disclosure. Reference will now be made in detail to implementations of the example aspects as illustrated in the accompanying drawings. The same reference indicators will be used to the extent possible throughout the drawings and the following description to refer to the same or like items.

Figure 1:
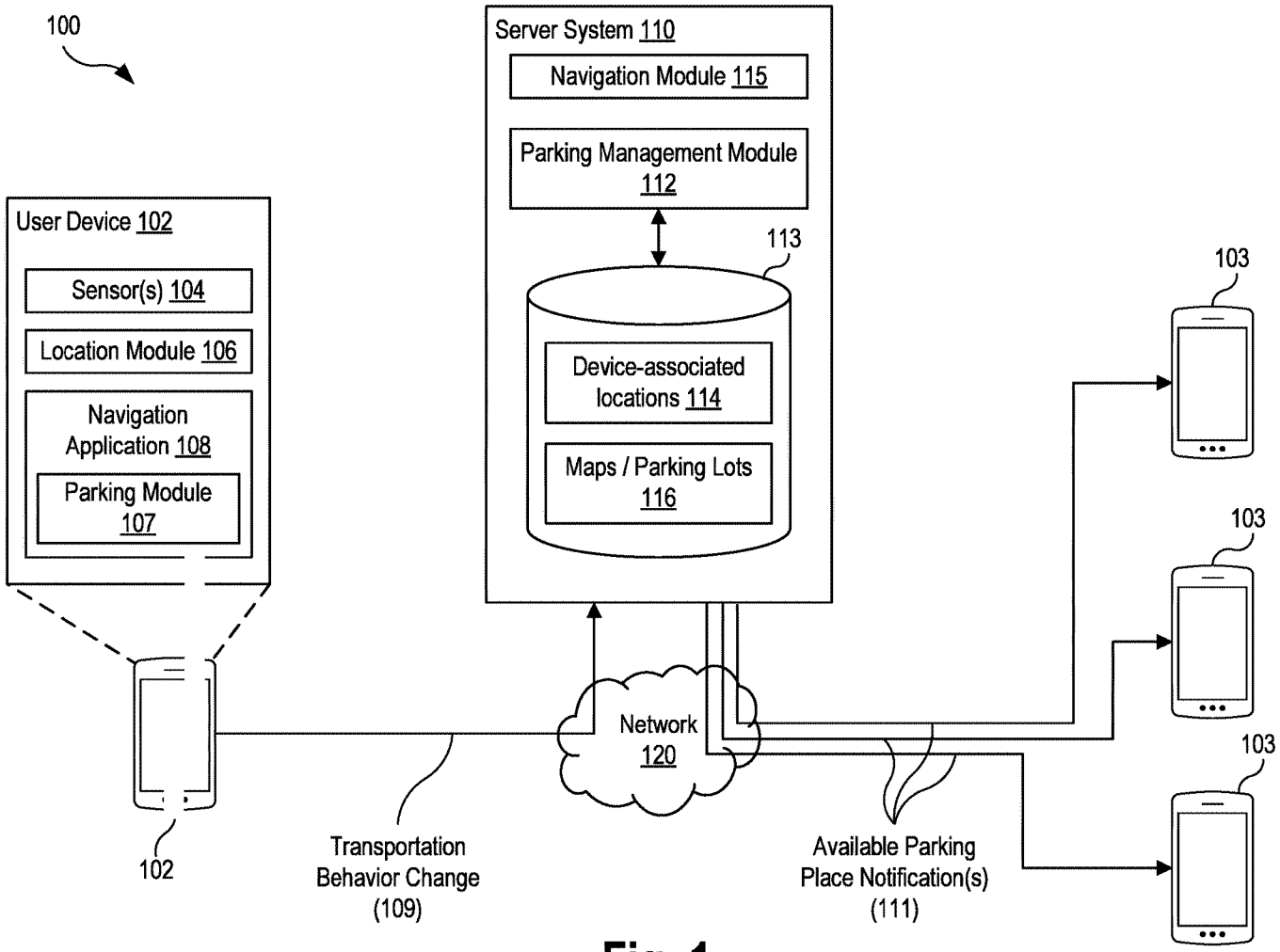
FIG. 1 is a block diagram illustrating a system for determining vehicle parking availability, according to an exemplary aspect.

FIG. 1 is a block diagram illustrating a system 100 for determining vehicle parking availability according to an exemplary aspect. The system 100 includes a plurality of electronic user devices 102, 103 communicatively connected to a server system 110 by a network 120, such as the Internet, via a wired or wireless connection. The user devices 102 may be a mobile device, smart phone, tablet, a desktop computer, a laptop, navigation system in a vehicle, etc. In one aspect, each of the user devices 102 may include one or more sensors 104, a location module 106, and a navigation application 108. While a single user device 102 is depicted in detail in FIG. 1, it is understood that the other user devices 103 may be similarly configured. For simplicity of explanation, the user device 102 is associated with a user departing a parking space, while other user devices 102 are associated with other users that may be looking for a parking space, but it is understood that at other times, the user of the user device 102 may be looking for parking space, and at least one of the other user devices 103 may be the ones departing a parking space.

In one aspect, the server system 110 may include a navigation module 115, a parking management module 112 and a database 113 configured to store a plurality of one or more device-associated locations 114, maps 116, and information related to parking spaces on maps 116.

The sensors 104 of the user device are configured to provide sensor data related to the physical motion of the user device 102. Such sensor data may be used to detect the activity or transportation behavior of the user of the user device 102. In some aspects, the sensors 104 may include one or more of an accelerometer, gyroscope, compass, barometer, heart-rate monitor, photo-sensors, and other discrete or integrated electromechanical devices. In some aspects, the sensors 104 may be integrated into the same user device 102 on which the navigation application 108 is running. In other examples, one or more sensors 104 may be disposed in another device, such as a wearable device or smart watch, which is configured to provide sensor data to the user device 102.

The location module 106 may be configured to generate location-based data associated with the location of the user device 102. In some aspects, the location module 106 may be a GPS (Global Positioning System) receiver configured to receive information from GPS satellites and then calculate the user device's geographic location. In some aspects, the location module 106 may be configured to augment the GPS information using wireless-network mapping techniques that determine a geographic location based on the presence of certain wireless networks proximate to the user device (e.g., Wi-Fi mapping).

In one aspect, the navigation application 108 (e.g., executing on the user device 102) may be configured to enable map and routing services provided by the navigation module 115 (e.g., executing on the server 110) based on the user device's geographical location. An example of the navigation application 108 may be Yandex.Maps™ or Yandex.Navigator™ applications made available by Yandex®.

In one aspect, the navigation application 108 may include a parking module 107 configured to detect when a user has parked a vehicle that the user device 102 is in, and when the user has departed a parking space in the vehicle. The parking module 107 may be used to detect when the user device is in a vehicle entering or departing a parking space, which can include a parking space found in a public parking lot, a parking lot of a mall, a parking lot of a shopping center, busy city streets, stadium parking lots, and other places where there is a high congestion of cars and notification of parking availability can be useful.

In one aspect, the parking module 107 may use the sensor data from the one or more sensors 104 to detect a change in transportation behavior. The parking module 107 may determine a parking behavior (i.e., that the user has performed a parking-related action) based on that change in transportation behavior. The parking module 107 may be configured to generate and transmit, to the server 110, an indication of transportation-behavior change of the user device using sensor data from the one or more sensors 104. As such, in contrast to prior approaches with require users to report free parking spaces, the parking module 107 automatically generates and transmits this transportation-behavior change without requiring an express action by the user that advertises an available parking space.

In one example, the parking module 107 may first determine that the user device 102 is on a walking person ("walking") based on sensor data from the accelerometer sensor 104 having a particular pattern and/or frequency. Subsequently, the parking module 107 later determines that the user device is in an automobile ("driving") based on speed data from the location module 106 and sensor data from the accelerometer sensor 104 having a particular pattern associated with automotive motion. In this example, the parking module 107 may generate an indication of a transportation-behavior change from "walking" to "driving," which the parking module 107 uses to infer that the user started driving, and hence has left their parking space.

Figure 2A:
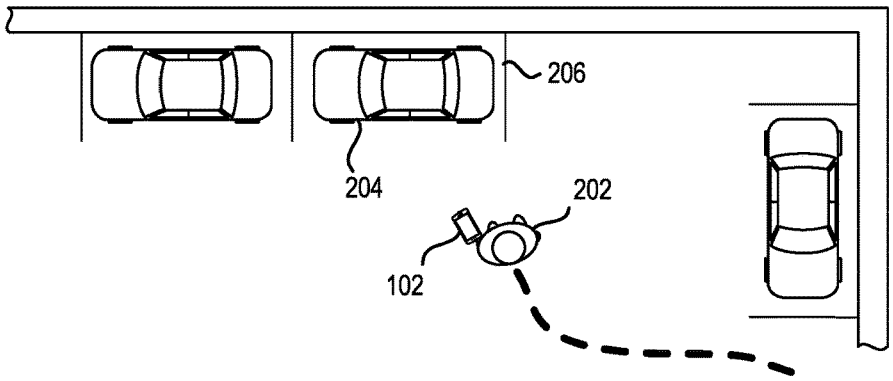
FIGS. 2A to 2C are block diagrams illustrating exemplary scenarios using a system for determining vehicle parking availability, according to an exemplary aspect.
Figure 2B:
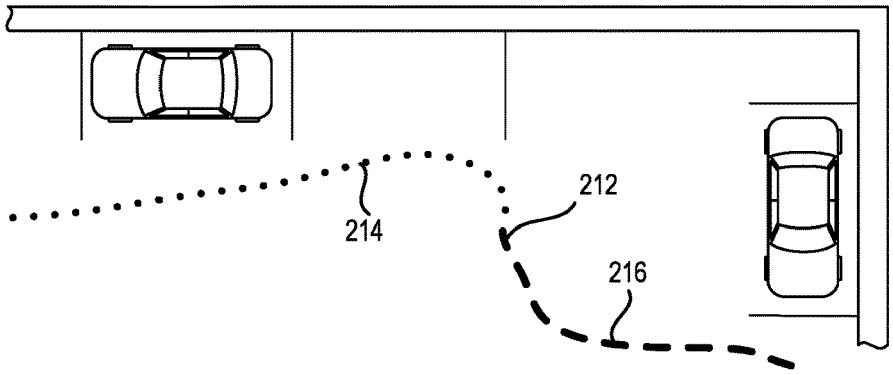

For example, FIGS. 2A and 2B are top views illustrating an example scenario of a user 202 operates a vehicle 204 to exit a parking space 206. As shown in FIG. 2A, at an initial time, the user 202 carrying the user device 102 walks to the parked vehicle 204, enters the vehicle, and drives out of the parking space 206 (i.e., de-parks). FIG. 2B depicts a resultant change in transportation behavior that includes a "walking" behavior (depicted by dashed path 216) to a "driving" behavior (depicted by a dotted path 214). The location 212 of the transportation-behavior change is proximate to the parking space 206 (and to other parking spaces). It is noted that the location 212 is depicted as offset from the precise location the user enters the vehicle in reality to reflect the real-life problem of inaccurate or noisy position information provided from the user device. Nonetheless, the parking management module 112 on the server system 110 receives, from the parking module 107 executing on the user device 102, an indication of a transportation-behavior change specifying a transportation-behavior change from the "walking" behavior to the "driving" behavior, suggesting a de-parking action by the user at the location 212.

Referring back to FIG. 1, in some implementations, the parking module 107 may use a system library supported by the user device 102 to detect the transportation behavior of the user device 102, for example, the Core Motion Activity library on iOS® operating system, or the Activity Recognition API on Android™ operating system. In addition to "walking" and "driving", other examples of transportation behaviors that may be detected include indications that the user device is in a bicycle ("bicycling"), that the user device is on a running person ("running"), that the user device is "stationary", or that the user device is in a train or subway.

Just as the parking module 107 may determine when a user device has departed a parking space, the parking module 107 may detect when a user device is in a vehicle that is parking in a parking space. The parking module 107 may use such information, in conjunction with the above-described transportation-behavior change, to determine that a parking space is becoming available. In some aspects, the parking module 107 may use a location of a prior transportation-behavior change to determine that a subsequent transportation-behavior change at that same location is a parking-related action. For example, at an initial time, the parking module 107 detects a behavior change from "driving" to "walking" indicative of the user parking into a parking space. The parking module 107 saves the location of this behavior change as the location of the user's parking action. At a subsequent time, when the user returns to their automobile (i.e., walks back) and drives out of the parking space, the parking module 107 detects this behavior change from "walking" to "driving" and identifies it as a possible de-parking action. Because the location of the de-parking action matches (or is substantially proximate to) the location of the prior parking action, the parking module 107 may determine the user device is involved with a de-parking behavior.

In some aspects, the parking module 107 may detect a parking behavior (i.e., that a user device is in a vehicle that is parking in a parking space) based a transportation-behavior change from "driving" to "walking" occurring proximate to a destination location provided by the navigation application 108. This aspect may be applied to a situation in which a user is using the navigation application 108 to provide a driving route to a destination, reaches their destination, and parks their automobile near the destination.

In other aspects, the parking module 107 may detect parking behavior based on whether a user device establishes or terminates a wireless connection to an automobile. Some automobiles include so-called "infotainment" systems that provide wireless connectivity (e.g., via Bluetooth® technology) to a user device for making telephone calls, playing music, or other features. As such, the parking module 107 may use the establishment of the wireless connection with the infotainment system of the automobile, which typically occurs when the user starts the automobile, as a factor in determining that the user device is in a vehicle departing a parking place. Similarly, the parking module 107 may use the termination of the wireless connection with the infotainment system, which can be associated with the user shutting off the automobile, as a factor in determining that the user device is in a vehicle that has just parked.

According to one aspect, the parking management module 112 (e.g., executing on the server system 110) may be configured to receive an indication of a transportation-behavior change (109) from one or more user devices 102. In some aspects, the indication of transportation-behavior change may be received as a determination made by the user device 102 itself; in other aspects, the received indication of transportation-behavior change may be the raw data from the sensors 104 of the user device (which the parking management module 112 then uses to make such a determination); or some combination of both. In some aspects, the received indication of the transportation-behavior change specifies a change from a first transportation behavior (e.g., "walking") to a second transportation behavior (e.g., "driving") at a first location (e.g., GPS coordinates).

The indication of a transportation-behavior change may be associated with a specific behavior pattern of a plurality of predetermined behavior patterns. For example, an indication of a change from "driving" to "walking" behaviors may suggest that the user has left their vehicle. In another example, an indication of a change back to "driving" may suggest the user has return to vehicle and has left the parking space.

Each indication of transportation-behavior change (109) that the server system 110 receives may include initial location coordinates (e.g., based on GPS-based based determined coordinates of the user device) associated with a specific user device. The server may save each of the signals along with a respective timestamp of the received signal to the database 113 (e.g., device-associated locations 114).

In some aspects, the parking management module 112 may be configured to detect whether the received location is within a predetermined area threshold of at least one of previous device-associated locations 114. This process addresses the real-life problem of users activating their navigation application 108 only after leaving a parking space (i.e., de-parking). In such a scenario, even with as little as a 2-minute delay, the parking management module 112 of the server will receive "noisy" coordinates, i.e., location coordinates which may be inaccurate from the actual location of where the user switched, for example, from walking to driving. If so, the parking management module 112 may use the previous location (if available), for example, if the user had been using the navigation application 108 while parking the vehicle, and the device 102 has sent the location-based information to the server. In other aspects, the parking management module 112 may use the previous user location to modify the location reported by the indication 109 of transportation-behavior change, for example, by averaging the two locations.

In one aspect, the parking management module 112 may be configured to match the user's approximate location (of the transportation-behavior change) to a plurality of parking lots around the user. In some aspects, the parking management module 112 may match the user's approximate location to a plurality of parking lots around the user, e.g., within a close map area section. In some aspects, the navigation server may use a map of available parking lots in close proximity to the user's location (e.g., a threshold area of within 100 meters).

In some aspects, the parking management module 112 may store records of predetermined parking spaces 116 within the database 113. Records of the parking spaces 116 may be organized into records of parking lots (also referred to as parking places) containing those parking spaces, which specify a set of features for each parking lot, including the geographic location of the parking lot (e.g., GPS coordinates, or map section indices), the type of parking (e.g., shared, permit only, locals only, paid, time limit), a total amount of parking spaces, and a level of popularity associated with the parking lot (e.g., how frequently the parking lot has been used in the past). By way of example, a parking lot in downtown area of cities may be outlined as a location having five to ten parking spaces, and there may be two to three lots with five spaces on the same street. In one example, the records may indicate that a street A has two parking lots, each having three parking spaces. In some aspects of the present disclosure, the level of precision or granularity of the described technique may be adapted to a scale associated with parking lots (rather than parking spaces), where the specific spaces in the parking lots may be approximate in about 1-meter error within the street. Hence, aspects of the present disclosure are designed to detect a place where there may be a free space in order to navigate users to the lot with potential free space(s).

In one aspect, the parking management module 112 may be configured to determine candidate parking-spaces close to the determined (or current) user location, and calculate a set of probabilities, each probability of the set of probabilities indicating a probability of which parking space the user's vehicle was parked in, and which has now become available. That is, each candidate parking space individually receives a weight (probability) indicating the confidence level that that parking space is where the user's vehicle was parked.

In some aspects, the parking management module 112 may calculate the set of probabilities based on a respective parking space's parking-availability probability, $P(\text{park}_i)$, which may be considered dependent on the current demand for the parking space, availability, and its maximum capacity, as represented in Equation (1) below:

$$P(\text{park}_i) \approx \propto \cdot f_{cool}(\text{park}_i) = \propto \cdot f_{cool}(\text{demand}_i, \text{availability}_i, \text{capacity}_i) \quad (1)$$

wherein $f_{cool}$ is a function for determining specific probability and may vary for different cities. For example, for a first city (e.g., Moscow) and parking spaces in the streets, $f_{cool}$ may be a first probability function depicting linear parking places in the streets, while for a second city (e.g., Los Angeles) and respectively mall parking places with hundreds parking spaces per each parking lot, a second probability function may be applied. In some aspects, the first probability function may be a cumulative distribution function, and a second probability function may be a probability mass function. In some aspects, each probability function use the set of factors described herein as a multivariate random variable, or random vector.

In some aspects, each parking-behavior event depends on a distance detection measurement. Practically speaking, the measurement shows user location's proximity to at least one parking place. Hence, if the system detects that the user is far from the closest parking place, the system may determine there is e no parking event detection, as shown in the relationship shown in Equations (2) and (3).

$$P(\text{event}_{x,y}^{True} \mid \text{park}) = 0, \quad (2)$$

where x,y are respective event and parking place coordinates and $$\text{distance}((x_{event}, y_{event}), (x_{park}, y_{park})) > C_{DistanceLimit} \quad (3)$$

Furthermore, the parking management module 112 may calculate the parking event probability based on following example Equation (4) below:

$$P(\text{park}_i \mid \text{event}_{x,y}) \approx \approx \tag{4}$$

$$\frac{\text{capacity}_i \cdot f_{distance}(\text{event}_{x,y}, \text{park}_i)}{\left(\sum_{park_j \in KnownNear_{x,y}} \text{capacity}_j \cdot f_{distance}(\text{event}_{x,y}^{True}, \text{park}_j)\right) + \alpha_{mt/park}^{ratio} \cdot \left(\sum_{stop_j \in KnownNear_{x,y}} \text{popularity}_j \cdot f_{distance}(\text{event}_{x,y}^{True}, \text{stop}_j)\right) + C_{unknownAndFalse}}$$

Figure 2C:
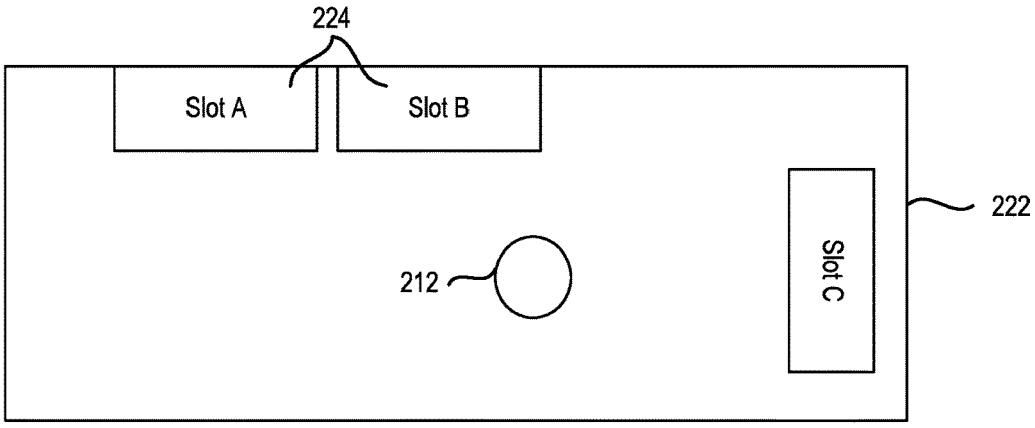

For example, as shown in FIG. 2C, the parking management module 112 matches the user-approximated location 212 to a plurality of parking spaces 224 around the user, for example, within the map section 222. The parking management module 112 determines that the user 202 has a probability that the user 202 has left Slot A with a 0.2 probability; Slot B with a 0.7 probability; and Slot C with a 0.1 probability, etc., based, for example, on such factors as, the user's current location relative to the location of each parking space, information about user driving time (if available, last know location of the user, direction in which the user is driving relative to the candidate parking space.

In some aspects, the parking management module 112 may use a set of additional factors for calculating the probabilities for each of the parking spaces. The set of factors may include, but not limited to: a size of the parking lot (e.g., dimensional size, number of spaces); a distance of the user to the available parking space; a current speed of the driving vehicle the user device 102 is in (if available), and other factors described below. In some aspects, the parking management module 112 may calculate the confidence level that a parking space is linked to the location of the transportation-behavior change based at least in part on a number of times, according to previously-recorded locations, that other users have used the parking space (i.e., "popularity"). In some aspects, the parking management module 112 may calculate the confidence level that a parking space is linked to the location of the behavior change based at least in part on the number of previously-recorded locations have been linked to or associated with the current parking space in a recent time period (e.g., within a last hour, last 24 hours, etc.). This use of previously-recorded locations (i.e., history logs) enable the parking management module 112 to correctly bind a user location to a parking place, particularly in locations where the GPS interference or noise is consistently inaccurate. In some aspects, the parking management module 112 may calculate the confidence level that a parking space is linked to the location of the transportation-behavior change based on the type of parking (e.g., free, paid, only for local residents) associated with the parking space. The specific type of parking may have a respective weight (for the "popularity" determining step). In other words, the number of previously-recorded locations or the number of parking events per each space or lot is deemed indicative of how many users or how many spaces of the parking lot have been used, e.g., during the last week. For example, a free parking space may be assigned a higher weight than a paid parking space, and a locals-only or permit-only parking space may be assigned a lowest weight of them all. The weights may be included in the probability calculations as an additional factor.

In some aspects, each of the set of factors may be assigned a different weight used for calculating the respective probability. For example, the parking management module 112 may calculate the probability associated with a particular parking space based on a heavily positive weight factor of distance to a parking space and on a less positive weighted factor of the popularity of the parking space.

In one aspect, the parking management module 112 may be configured to determine an available parking space associated with the transportation-behavior change based on a calculated maximal probability of the set of probabilities. That is, the server specifically links or associates, based on a highest confidence level (probability), a current user initial location with at least one of a set of the candidate spaces (to be the parking place the user has left). In the above example, the parking management module 112 determines the 0.7 probability (associated with Slot B) to be the maximum confidence level of the candidate spaces and hence determines that the user had left Slot B.

In another aspect, the parking management module 112 may be configured to detect the parking spaces associated with the transportation-behavior change based on calculated low probabilities of the set of probabilities. For such parking spaces, the parking management module 112 may record an indication (based on increased time measurements) of factually less popular parking spaces. The parking management module 112 may less frequently recommend those less popular parking spaces (e.g. they may be less visible or hard to get, etc.) to the users.

The parking management module 112 may be further configured to provide other user devices 103 with available parking space notifications 111 indicating a potentially available parking space at the recently departed place. The information about available parking spaces may be delivered to other users of the navigation software, which have routed planned endings close to the space.

In some aspects, the parking module 107 of the other user devices 103 may be configured to modify a graphical user interface of the navigation application 108 to display the notification of the available parking space within a map region. An example of such a notification is depicted in FIG. 3.

Figure 3:
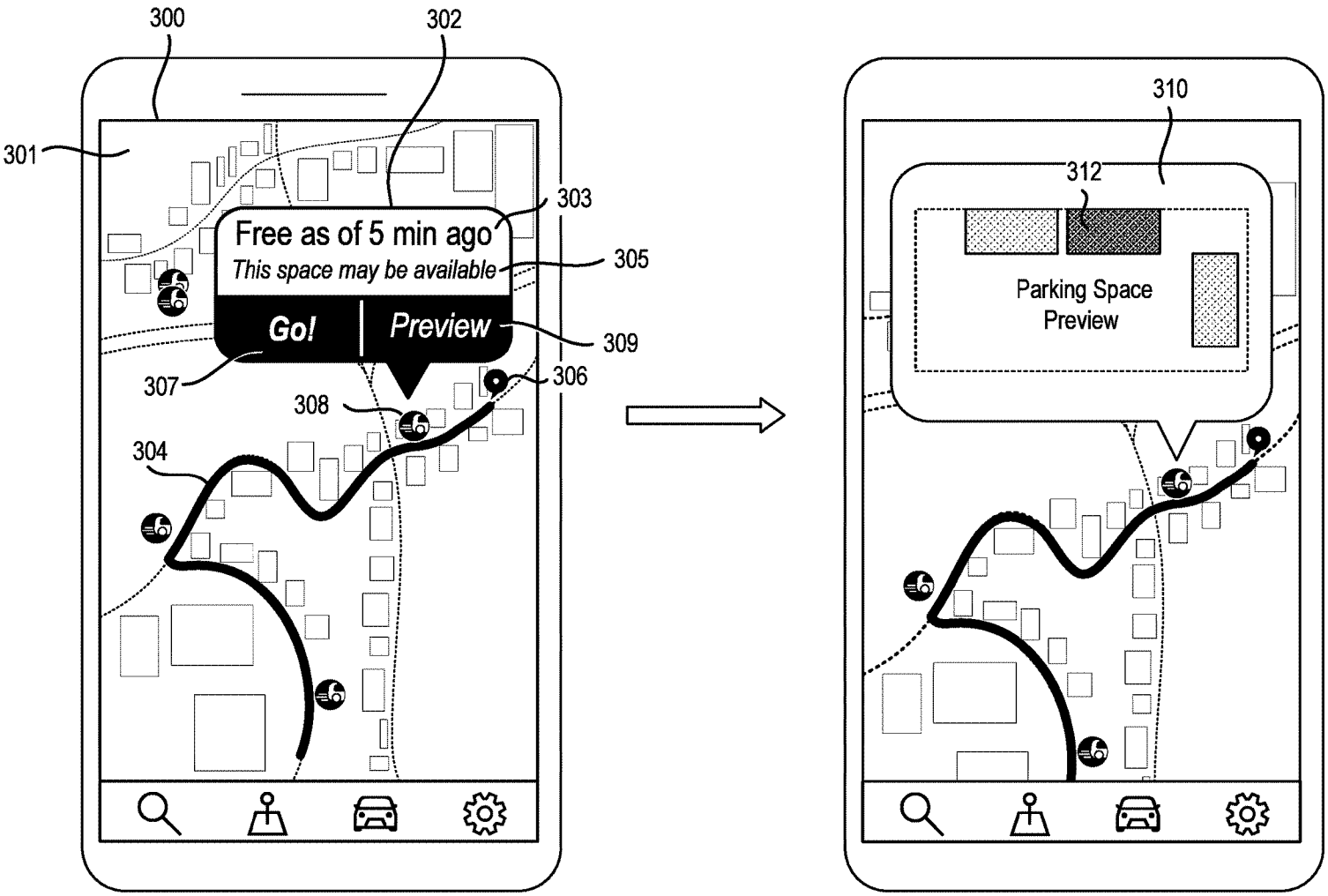
FIG. 3 is a block diagram illustrating a graphical user interface for notifying users of parking availability determined according to an exemplary aspect.

FIG. 3 is a block diagram illustrating a sequence of graphical user interfaces 300 for notifying users for parking availability determined according to an exemplary aspect. The graphical user interface 300 may be generated, rendered, and displayed on those user devices 103 configured to receive available parking place notifications 111. As shown, the graphical user interface 300 includes a map image 301 having a route indication (depicted as line 304) to a destination (depicted by an icon 306). In response to receiving a notification 111, the navigation application 108 may modify the graphical user interface 300 to include a graphical indication 302 notifying the user that there may be an available parking space. The graphical indication 302 includes one or more icon 308 (e.g., departing car icon) specifying an available parking space and rendered on a location of the map image corresponding to the approximate location of the available parking space. The graphical indication 302 may further specify an indication of age 303 association with the availability notification ("Free as of 5 minutes ago") which can be determined by the parking management module 112 using the timestamp of the indication of the transportation-behavior change.

In some aspects, the graphical indication 302 further includes an indication of a parking-availability probability 305 associated with the parking availability that represents a likelihood that the current navigation user will be able to obtain the parking space. In some aspects, the indication of the parking-availability probability 305 may be rendered as textual information (e.g., "This space may be available"). The textual information may be mapped to a range of parking-availability probabilities, from likely to unlikely (e.g., "There is a good chance this space is available" to "It is possible that this space is available"). In some aspects, the indication of parking-availability probability may be represented using different graphical cues corresponding to the different probabilities, including font color, font weight, type face, etc. For example, if the parking-availability probabilities is high, i.e., there is a high likelihood that navigation user may be able to obtain the parking space, the indication of the parking-availability probability 305 may be rendered in a green font color; if low, the indication might be rendered in a red font color. In some aspects, the navigation application may map a numerical indication of parking-availability to a corresponding textual or graphical indication using discretization techniques. For example, in response to receiving a value of 0.8 parking-availability probability, the navigation application may determine this value falls within a 0.75 to 1.0 range, and generates and renders a text description of "There is a good chance this space is available" in a bold-face green font. In another example, in response to receiving a value of 0.13 parking-availability probability, the navigation application may determine this value falls within a 0.0 to 0.33 range, and generates and renders a text description of "It is possible that this space is available" in a red font.

In some aspects, the graphical indication 302 may include one or more control elements (e.g., buttons) associated with the available parking space. One control element may be a "Go" button 307 configured to, when activated, signal to the parking management module 112 of the navigation user's intention to obtain the available parking space. In some aspects, responsive to a user input on the Go button 307 (e.g., tap, click), the navigation application 108 may generate a new route, or modify an existing route, having a destination or a stop set to the location of the available parking space.

Another control element of the graphical indication 302 may be a preview button 309 configured to, when activated, provide the navigation user with information related to the available parking space. In the example shown, responsive to a user input (e.g., tap) on the preview button 309, the navigation application 108 may modify the graphical user interface to include a graphical preview 310 of the parking space. For example, the graphical preview 310 may include map imagery illustrating the available parking space (depicted as box 312) in the context of surrounding parking spaces. The available parking space may be rendered differently than the surrounding (occupied) parking spaces, for example, using a different color, shape, or fill pattern (as shown in FIG. 3). The map imagery may be rendered as overlaid or inset to the original map image 301. In some aspects, the map imagery of the parking spaces may be provided by the parking management module 112 from the database 113 of maps and parking spaces 116.

According to one aspect of the present disclosure, the parking management module 112 may be configured to apply probabilistic analysis to determine which users of other devices 103 (herein referred to as navigation users) are likely to obtain an available parking space. In this aspect, the parking management module first identifies, using records of parking spaces stored in the database 113, an available parking space based on the received indication of the transportation-behavior change (as described above). The parking management module then determines one or more navigation users that are either currently proximate to the available parking space, or on a route (i.e., provided by the navigation application) having a destination proximate to the available parking space.

According to one aspect, the parking management module 112 may calculate for each navigation user another form of probability, referred to herein as a parking-availability probability, associated with a likelihood that the respective navigation user will obtain the available parking space. The parking-availability probability may use a set of factors for calculating parking-availability probabilities for each navigation user, such as a distance from a current location of the navigation user to the location of the available parking place, an estimated time of arrival of the navigation to the available parking space, a number of other navigation users in the area around the available parking space, a number of other navigation users having a destination in the area near the available parking space. Other factors that may be used to calculate the parking-availability probability for a respective navigation user include a popularity of the parking lot (e.g., as determined by the frequency of other users using the parking space according to previously-recorded parking locations); a size of the parking lot in which the available parking space is in (which relates to the parking capacity of the surrounding area); the type of parking, such as free parking, paid parking, permit-only, and/or time-restricted (which relates to the demand for the parking space); the number of other users who have higher probabilities of getting a particular parking space; presence of the water hydrant next to the parking space; alternate side parking rules currently in effect due to street cleaning; a suspension of parking prohibition rules due to holidays or weekends that is currently in effect; unavailability of parking because of street closures due to, for example, ongoing road repairs, carnivals, parades, block parties, dignitary visits, etc.; and other reasons that can affect parking availability.

In some aspects, the parking management module 112 may incorporate the calculated parking-availability probability associated with a navigation user with each of the probabilities (i.e., confidence levels) associated with a parking space in order to calculate a cumulative probability associated with a parking space. That is, the parking management module 112 may determine a cumulative probability based on both the confidence level ($P_A$) that another user has departed a particular parking space with the parking-availability probability ($P_P$) that a particular navigation user will be able to obtain that parking space. This relationship may be represented by Equation (5).

$$P_C = w_1 P_A * w_2 P_P \quad (5),$$

where $P_C$ is a cumulative probability associated with a likelihood that a given parking space is available and that a given user will obtain that parking space, and where $w_1$ and $w_2$ are weight or coefficient factors associated with the confidence level $P_A$ and parking-availability probability $P_P$, respectively. In some aspects, the calculated cumulative probability may be calculated based on a sum of respective ($w_1 P_a$) and ($w_2 P_p$). In some aspects, the calculated cumulative probability may be used in lieu of the parking-availability probability, for example, in determining which navigation users to notify as described below.

In one aspect, the parking management module 112 may be configured to transmit, according to the calculated parking-availability probabilities, a notification of the available parking space to at least one of the navigation users. In some aspects, the parking management module 112 may select a subset of the navigation users having an associated parking-availability probability of obtaining the available parking space that exceeds a threshold value, and transmit the notification to that selected subset. For example, the parking management module 112 may only notify those navigation users having a parking-availability probability of 0.75 or greater of the available parking space (other threshold probabilities may be used). This may save from sending notifications with a low likelihood of success, thereby reducing network and processing resources used by the system. In other aspects, the parking management module 112 may rank the navigation users according to the associated parking-availability probability of obtaining the available parking space, and transmit the notification to a subset of the ranked navigation users (e.g., top-Nth). For example, the parking management module 112 may notify the navigation users having the top ten (or other number) highest parking-availability probabilities.

In some aspects, the parking module 107 on the client side (e.g., user device 102) and the parking management module 112 on the server side (e.g., server system 110) may be configured to distribute the above-described operations in different configurations. That is, in some aspects, certain actions can be changed to be performed client-side or to be performed server-side. For example, in alternative aspects, rather than transmit determinations of the transportation-behavior change to the server, the client-side parking module 107 may be configured to download maps and information related to parking spaces in order to calculate the set of probabilities itself. After calculating the highest probability parking place, the client-side parking module 107 may transit an indication of an available parking place that includes geographic location of the parking space (e.g., GPS coordinates) or other identifier (e.g., unique identifier for a parking space). Similarly, in alternative aspects, rather than receive determinations of transportation-behavior change, the server-side parking management module 112 may receive the raw sensor data from the parking module 107, and determine parking behavior based on the received sensor data.

In another aspect of the present disclosure, the parking module 107 may be executing on a navigation device of the automobile itself. For example, the navigation application 108 may be a navigation module integrated into the infotainment system of the automobile, or a discrete GPS navigator device (e.g., TomTom® receiver). In such aspects, the parking module 107 may still detect changes in transportation behavior using data received from a control module of the automobile (e.g., the Engine Control Module, or ECM), which can provide indication of when the automobile is in a Park or Drive transmission mode, as well as information of when the automobile is started or turned off.

The term "module" as used herein means a real-world device, apparatus, or arrangement of modules implemented using hardware, such as by an application specific integrated circuit (ASIC) or field-programmable gate array (FPGA), for example, or as a combination of hardware and software, such as by a microprocessor system and a set of instructions to implement the module's functionality, which (while being executed) transform the microprocessor system into a special-purpose device. A module can also be implemented as a combination of the two, with certain functions facilitated by hardware alone, and other functions facilitated by a combination of hardware and software. In certain implementations, at least a portion, and in some cases, all, of a module can be executed on the processor of a general purpose computer (such as the one described in greater detail in FIG. 7 below). Accordingly, each module can be realized in a variety of suitable configurations, and should not be limited to any particular implementation exemplified herein.

Figure 4:
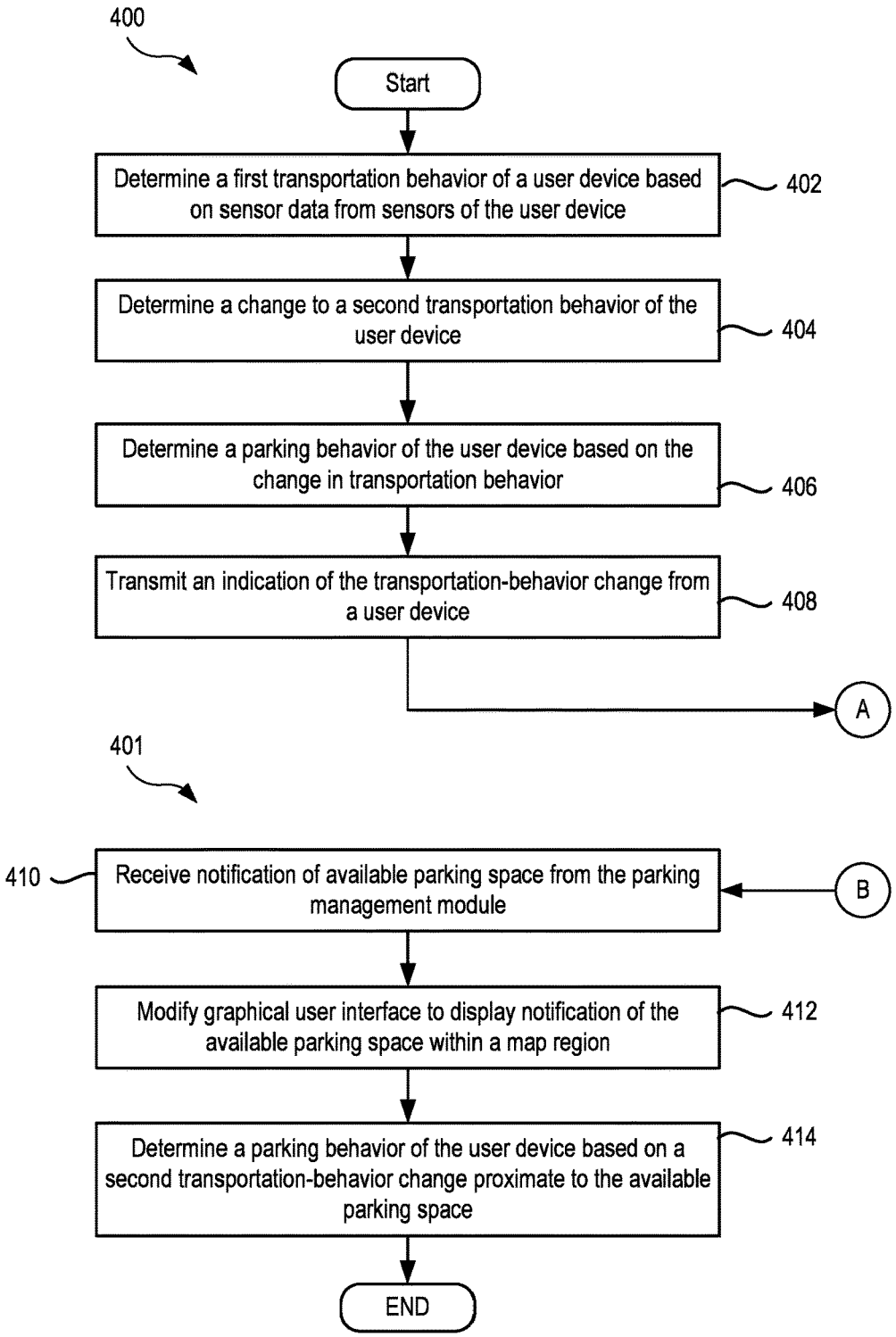
FIG. 4 is a flowchart illustrating a method for determining vehicle parking availability according to an exemplary aspect.

FIG. 4 is a flowchart illustrating a method 400 for determining parking availability that may be performed by a parking module 107 executing on the user device 102, according to an exemplary aspect. It is noted that the following description of the exemplary method makes reference to the system and components described above.

At step 402, the parking module 107 (e.g., executing on the user device 102) may determine a first transportation behavior of the user device based on sensor data from sensors of the user device. In one example, the transportation behavior may be "walking". In some aspects, the parking module 107 may detect that the user device 102 is on a walking person ("walking") based on sensor data from the accelerometer sensor 104 having a particular pattern and/or frequency. That is, readings from the accelerometer and other sensors 104 correlate to the physical movement of the user, including particular bumps and jostles at a certain cadence associated with human walking.

At step 404, the parking module 107 determines a change to a second transportation behavior of the user device. For example, the transportation behavior may change from "walking" (as determined in step 402) to "driving". In some aspects, the parking module 107 may detect that the user device is in an automobile based on a speed data from the location module 106 and sensor data from the accelerometer sensor 104 having a particular pattern associated with automotive motion. For example, speed data from the location module 106 indicating the user device has a speed exceeding 25 mph strongly suggests the mode of transportation is an automotive or other vehicle. Meanwhile, the data from the accelerometer may indicate physical movement with smooth acceleration and speed.

At step 406, the parking module 107 determines a parking behavior of the user device based on this change in transportation behavior. That is, the parking module 107 may determine that the user has departed their parking space based on data indicating the user device was on a walking person and is now in an automobile, which suggests the situation of a user walking to their parked car, and driving away from the parking space.

At step 408, the parking module 107 may transmit an indication of the transportation-behavior change 109 from the user device 102 to the parking management module 112 executing on the server system 110. The transmitted indication of transportation-behavior change (109) may include location data (e.g., based on GPS-based based determined coordinates of the user device) associated with the user device 102, along with a timestamp indicating a date and time of the transportation-behavior change.

Figure 5:
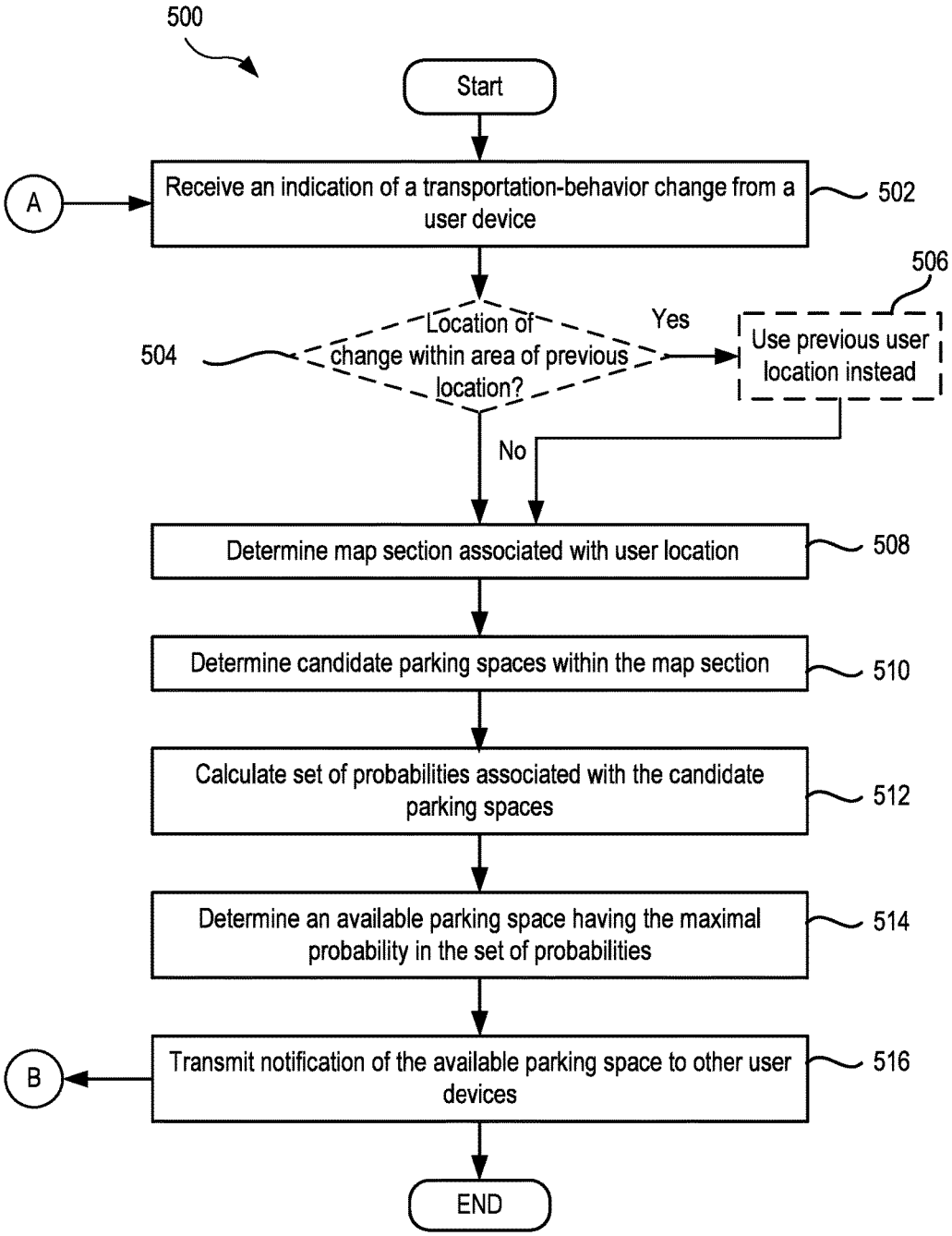
FIG. 5 is a flowchart illustrating a method for determining vehicle parking availability according to another exemplary aspect.

FIG. 5 is a flowchart illustrating a method 500 for determining parking availability that may be performed by a server-side parking management module 112 according to an exemplary aspect. It is noted that the following description of the exemplary method makes reference to the system and components described above.

At step 502, the parking management module 112 receives an indication of a transportation-behavior change from a user device. The indication of the transportation-behavior change may include a location and timestamp associated with the transportation-behavior change. In some aspects, the indication of transportation-behavior change may be received as a determination made by the user device 102 itself; in other aspects, the received indication of transportation-behavior change may be the raw data from the sensors 104 of the user device (which the parking management module 112 then uses to make such a determination); or some combination of both.

At step 504, the parking management module 112 may optionally detect whether the received location is within a predetermined area threshold of at least one of previous device-associated locations 114. This process addresses the real-life problem of users activating their navigation application 108 only after leaving a parking space (i.e., deparking). In such a scenario, even with as little as a 2-minute delay, the parking management module 112 of the server will receive "noisy" coordinates, i.e., location coordinates which may be inaccurate from the actual location of where the user switched, for example, from walking to driving.

If so, at step 506, responsive to detecting that the received location is within a threshold proximity to a device-associated location, the parking management module 112 may use the previous user location instead of the location included with the indication of the transportation-behavior change (received at step 502). In some aspects, the parking management module 112 may use the previous user location (if available), for example, if the user had been using the navigation application 108 while parking the vehicle, and the device 102 has sent the location-based information to the server. In other aspects, the parking management module 112 may use the previous user location to modify the location reported by the indication 109 of transportation-behavior change, for example, by averaging the two locations.

At step 508, the parking management module 112 may determine a map section associated with the location of the transportation-behavior change. In some aspects, the parking management module 112 may match the user's approximate location to a plurality of parking lots around the user, e.g., within a proximate map area section. In some aspects, the navigation server may use a map of available parking lots in close proximity to the user's location (e.g., within 100 meters).

At step 510, the parking management module 112 determines a plurality of candidate parking spaces to be associated with the transportation-behavior change of the device. In some aspects, the parking management module 112 determines the plurality of candidate parking spaces that are located within the map section (as determined in step 508).

At step 512, the parking management module 112 calculates a set of probabilities associated with the candidate parking spaces. Each probability of the set of probabilities specifies a confidence level that the location of the transportation-behavior change is located at a respective candidate parking space. In some aspects, each parking space individually receives a weight (probability) indicating the probability that a particular parking space will be associated with the user location.

At step 514, the parking management module 112 determines an available parking space associated with the transportation-behavior change based on a calculated maximal probability of the set of probabilities. At step 516, the parking management module 112 transmits notification of the available parking space to the other user devices 103. In some aspects, the parking management module 112 transmits a notification including a geographic location of the determined available parking space to the other user devices 103. In some aspects, the transmitted notification of the available parking space may include a probability or confidence level associated with the availability parking space.

The other user devices 103 may be executing their own respective instances of the navigation application 108 to provide, for example, their respective users with routing and navigation services to a particular destination. The parking management module 112 may conclude that at least some of those other users may need to find parking upon reaching those destinations. As such, in some aspects, the parking management module 112 may determine one or more users having routes with destinations proximate to the determined available parking space, and just notify those users of the available parking space.

Referring back to a method 401 in FIG. 4, at step 410, a parking module 107 of another (second) user device 103 may receive one or more notifications of available parking space from the parking management module 112. At step 412, the parking module 107 may modify a graphical user interface of the navigation application 108 to display the notification of the available parking space within a map region.

At step 414, the parking module 107 may determine a parking behavior of the user device 103 based on a second transportation-behavior change proximate to the available parking space. That is, the parking module 107 may detect that the user has claimed the available parking space, and notifies the parking management module 112 that the parking space is no longer available. In this way, the parking management module 112 may update its records and/or no longer advertise the availability of that particular parking space.

Figure 6:
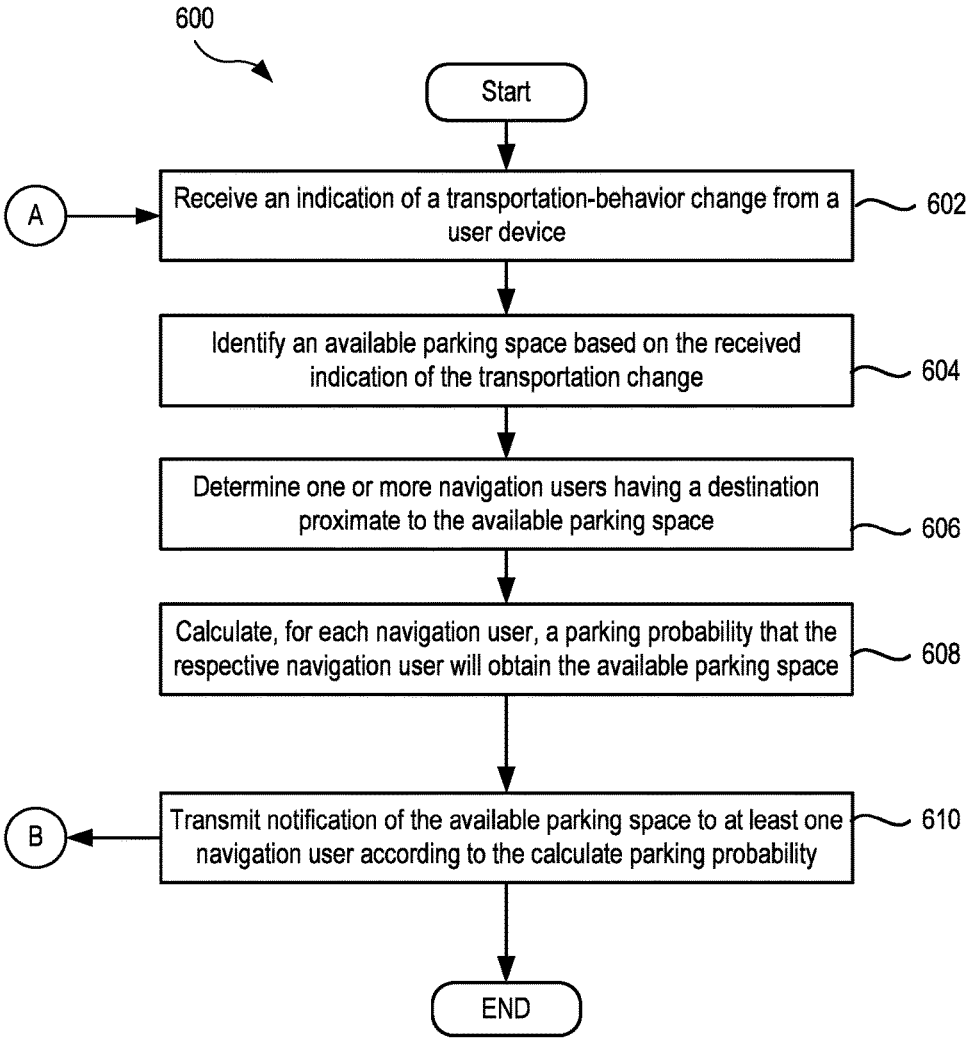
FIG. 6 is a flowchart illustrating a method for managing vehicle parking availability according to an exemplary aspect.

FIG. 6 is a flowchart illustrating a method 600 for managing parking availability that may be performed by a server-side parking management module 112 according to an exemplary aspect. It is noted that the following description of the exemplary method makes reference to the system and components described above.

At step 602, the parking management module 112 may receive an indication of a transportation-behavior change from a device (e.g., a user device 102). The indication of the transportation-behavior change specifies a change from a first transportation behavior to a second transportation behavior at a first location.

At step 604, the parking management module 112 identifies, using records of parking spaces stored in a database 113, an available parking space based on the received indication of the transportation-behavior change. In some aspects, the parking management module 112 may use a probabilistic analysis in which the parking management module 112 identifies one or more candidate parking spaces based on the location of the transportation-behavior change associated with the user of the device, and calculates a set of second probabilities associated with the candidate parking spaces. Each probability of the set of second probabilities specifying a confidence level that the location of the transportation-behavior change is located at a respective candidate parking space. The parking management module 112 then identifies the available parking space associated with the transportation-behavior change based on a calculated maximal probability of the set of second probabilities. The set of probabilities associated with the candidate parking spaces can be calculated based on at least one of a set of factors including a size of a parking lot, a distance of a parking space to the location of the transportation-behavior change, a type of parking, a number of times other users that have been associated with the parking space, and a number of previously-recorded locations have been associated with the respective parking space in a prior time period.

At step 606, the parking management module 112 determines one or more navigation users having a destination proximate to the available parking space. At step 608, the parking management module 112 calculates, for each navigation user, a parking-availability probability that the respective navigation user will obtain the available parking space. In some aspects, the parking management module 112 may calculate a cumulative probability based on at least one from the set of second probabilities associated with a first parking place and on at least one from the set of parking-availability probabilities associated with a navigation user. The cumulative probability represents a likelihood that the first parking space is available and that the navigation user will obtain the first parking space.

At step 610, the parking management module 112 transmits, to at least one of the navigation users, a notification of the available parking space according to the calculated parking-availability probabilities. In some aspects, the parking management module 112 may select a subset of the navigation users having an associated parking-availability probability of obtaining the available parking space that exceeds a first threshold value, and transmit the notification to that selected subset. In other aspects, the parking management module 112 may rank the navigation users according to the associated parking-availability probability of obtaining the available parking space, and transmit the notification to a subset of the ranked navigation users.

Figure 7:
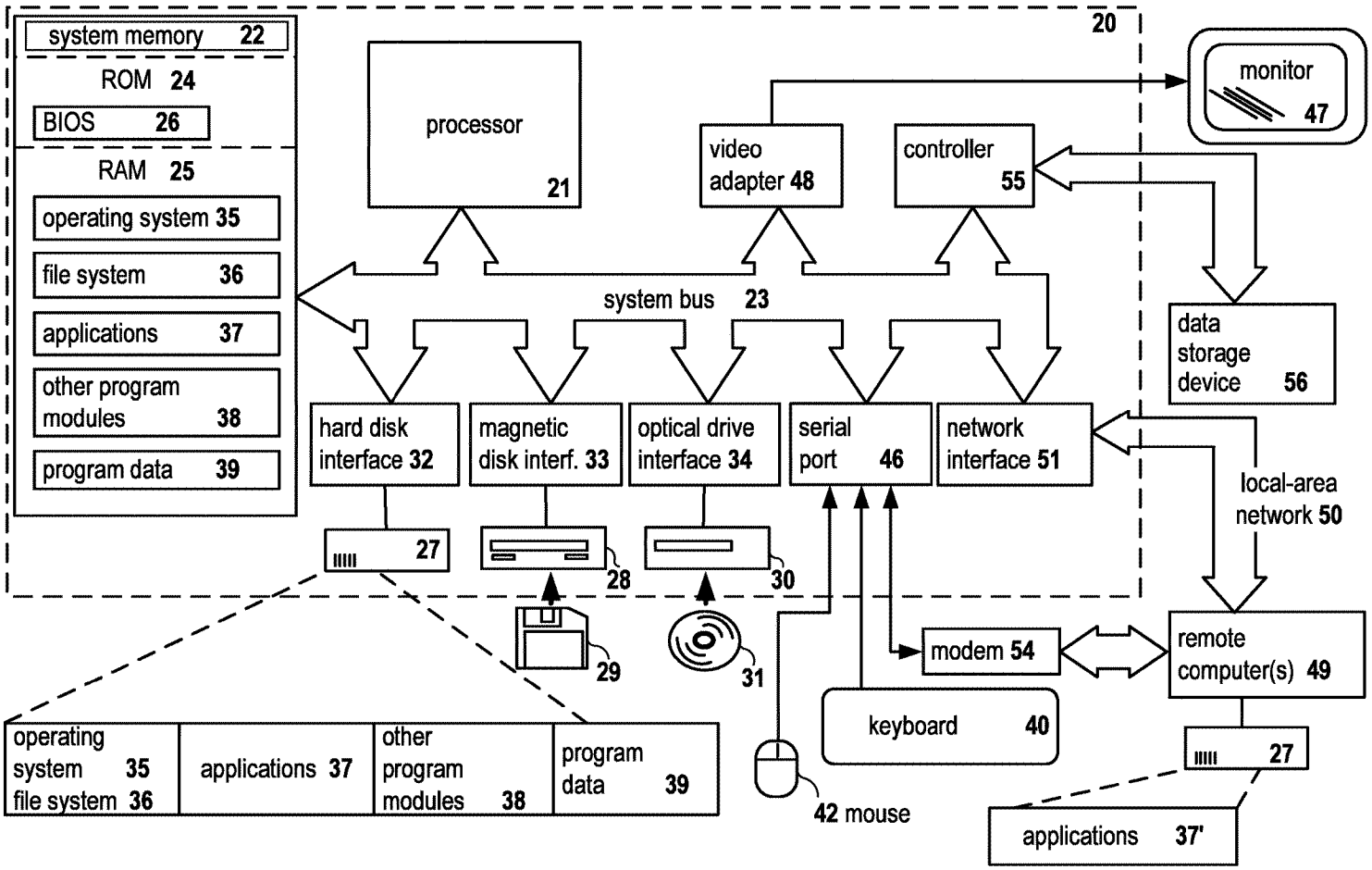
FIG. 7 is a block diagram of a general-purpose computer system on which the disclosed system and method can be implemented according to an exemplary aspect.

FIG. 7 is a block diagram illustrating a general-purpose computer system 20 on which aspects of systems and methods for detecting parking space availability may be implemented in accordance with an exemplary aspect. It should be noted that the computer system 20 can correspond to the user devices 102 and server system 110, for example, described earlier.

As shown, the computer system 20 (which may be a personal computer or a server) includes a central processing unit 21, a system memory 22, and a system bus 23 connecting the various system components, including the memory associated with the central processing unit 21. As will be appreciated by those of ordinary skill in the art, the system bus 23 may comprise a bus memory or bus memory controller, a peripheral bus, and a local bus that is able to interact with any other bus architecture. The system memory may include permanent memory (ROM) 24 and random-access memory (RAM) 25. The basic input/output system (BIOS) 26 may store the basic procedures for transfer of information between elements of the computer system 20, such as those at the time of loading the operating system with the use of the ROM 24.

The computer system 20, may also comprise a hard disk 27 for reading and writing data, a magnetic disk drive 28 for reading and writing on removable magnetic disks 29, and an optical drive 30 for reading and writing removable optical disks 31, such as CD-ROM, DVD-ROM and other optical media. The hard disk 27, the magnetic disk drive 28, and the optical drive 30 are connected to the system bus 23 across the hard disk interface 32, the magnetic disk interface 33 and the optical drive interface 34, respectively. The drives and the corresponding computer information media are power-independent modules for storage of computer instructions, data structures, program modules and other data of the computer system 20.

An exemplary aspect comprises a system that uses a hard disk 27, a removable magnetic disk 29 and a removable optical disk 31 connected to the system bus 23 via the controller 55. It will be understood by those of ordinary skill in the art that any type of media 56 that is able to store data in a form readable by a computer (solid state drives, flash memory cards, digital disks, random-access memory (RAM) and so on) may also be utilized.

The computer system 20 has a file system 36, in which the operating system 35, may be stored, as well as additional program applications 37, other program modules 38, and program data 39. A user of the computer system 20 may enter commands and information using keyboard 40, mouse 42, or any other input device known to those of ordinary skill in the art, such as, but not limited to, a microphone, joystick, game controller, scanner, etc. Such input devices typically plug into the computer system 20 through a serial port 46, which in turn is connected to the system bus, but those of ordinary skill in the art will appreciate that input devices may be also be connected in other ways, such as, without limitation, via a parallel port, a game port, or a universal serial bus (USB). A monitor 47 or other type of display device may also be connected to the system bus 23 across an interface, such as a video adapter 48. In addition to the monitor 47, the personal computer may be equipped with other peripheral output devices (not shown), such as loudspeakers, a printer, etc.

Computer system 20 may operate in a network environment, using a network connection to one or more remote computers 49. The remote computer (or computers) 49 may be local computer workstations or servers comprising most or all of the aforementioned elements in describing the nature of a computer system 20. Other devices may also be present in the computer network, such as, but not limited to, routers, network stations, peer devices or other network nodes.

Network connections can form a local-area computer network (LAN) 50 and a wide-area computer network (WAN). Such networks are used in corporate computer networks and internal company networks, and they generally have access to the Internet. In LAN or WAN networks, the personal computer 20 is connected to the local-area network 50 across a network adapter or network interface 51. When networks are used, the computer system 20 may employ a modem 54 or other modules well known to those of ordinary skill in the art that enable communications with a wide-area computer network such as the Internet. The modem 54, which may be an internal or external device, may be connected to the system bus 23 by a serial port 46. It will be appreciated by those of ordinary skill in the art that said network connections are non-limiting examples of numerous well-understood ways of establishing a connection by one computer to another using communication modules.

In various aspects, the systems and methods described herein may be implemented in hardware, software, firmware, or any combination thereof. If implemented in software, the methods may be stored as one or more instructions or code on a non-transitory computer-readable medium. Computer-readable medium includes data storage. By way of example, and not limitation, such computer-readable medium can comprise RAM, ROM, EEPROM, CD-ROM, Flash memory or other types of electric, magnetic, or optical storage medium, or any other medium that can be used to carry or store desired program code in the form of instructions or data structures and that can be accessed by a processor of a general purpose computer.

In various aspects, the systems and methods described in the present disclosure can be addressed in terms of modules. The term "module" as used herein refers to a real-world device, component, or arrangement of components implemented using hardware, such as by an application specific integrated circuit (ASIC) or field-programmable gate array (FPGA), for example, or as a combination of hardware and software, such as by a microprocessor system and a set of instructions to implement the module's functionality, which (while being executed) transform the microprocessor system into a special-purpose device. A module may also be implemented as a combination of the two, with certain functions facilitated by hardware alone, and other functions facilitated by a combination of hardware and software. In certain implementations, at least a portion, and in some cases, all, of a module may be executed on the processor of a general purpose computer (such as the one described in greater detail in FIG. 7, above). Accordingly, each module may be realized in a variety of suitable configurations, and should not be limited to any particular implementation exemplified herein.

In the interest of clarity, not all of the routine features of the aspects are disclosed herein. It would be appreciated that in the development of any actual implementation of the present disclosure, numerous implementation-specific decisions must be made in order to achieve the developer's specific goals, and these specific goals will vary for different implementations and different developers. It is understood that such a development effort might be complex and time-consuming, but would nevertheless be a routine undertaking of engineering for those of ordinary skill in the art, having the benefit of this disclosure.

Furthermore, it is to be understood that the phraseology or terminology used herein is for the purpose of description and not of restriction, such that the terminology or phraseology of the present specification is to be interpreted by the skilled in the art in light of the teachings and guidance presented herein, in combination with the knowledge of the skilled in the relevant art(s). Moreover, it is not intended for any term in the specification or claims to be ascribed an uncommon or special meaning unless explicitly set forth as such.

The various aspects disclosed herein encompass present and future known equivalents to the known modules referred to herein by way of illustration. Moreover, while aspects and applications have been shown and described, it would be apparent to those skilled in the art having the benefit of this disclosure that many more modifications than mentioned above are possible without departing from the inventive concepts disclosed herein.

What is claimed is:

1. A computer-implemented method for managing vehicle parking availability, comprising:

receiving, from a device, an indication of a transportation-behavior change associated with a first user, wherein the indication of the transportation-behavior change specifies a change from a first transportation behavior to a second transportation behavior at a first location;

identifying, using records of parking spaces stored in a database, an available parking space based on the received indication of the transportation-behavior change;

determining one or more navigation users having a destination proximate to the available parking space;

calculating, for each navigation user, a parking-availability probability that a respective navigation user will obtain the available parking space;

transmitting, to at least one of the navigation users, a notification of the available parking space according to the calculated parking-availability probabilities, wherein the transmitting comprises:

selecting a subset of the navigation users having an associated parking-availability probability of obtaining the available parking space that exceeds a first threshold value; and transmitting the notification of the available parking space according to the calculated parking-availability probabilities to the selected subset.

2. The method of claim 1, wherein identifying the available parking space having become available based on the received indication of the transportation-behavior change further comprises:

identifying one or more candidate parking spaces based on the location of the transportation-behavior change associated with the user of the device;

calculating a set of second probabilities associated with the candidate parking spaces, each probability of the set of second probabilities specifying a confidence level that the location of the transportation-behavior change is located at a respective candidate parking space;

identifying the available parking space associated with the transportation-behavior change based on a calculated maximal probability of the set of second probabilities.

3. The method of claim 2, wherein calculating the set of second probabilities associated with the candidate parking spaces is based on at least one of a set of factors including a size of a parking lot, a distance of a parking space to the location of the transportation-behavior change, a type of parking, a number of times other users have been associated with the parking space, and a number of previously-recorded locations have been associated with the respective parking space in a prior time period.

4. The method of claim 2, further comprising:

calculating a cumulative probability based on at least one from the set of second probabilities associated with the available parking space and on at least one from the set of parking-availability probabilities associated with a navigation user, wherein the cumulative probability represents a likelihood that the available parking space is available and that the navigation user will obtain the first parking space.

5. The method of claim 1, wherein transmitting, to at least one of the navigation users, the notification of the available parking space according to the calculated parking-availability probabilities further comprises:

ranking the navigation users according to the associated parking-availability probability of obtaining the available parking space; and transmitting the notification to a subset of the ranked navigation users.

6. A system for managing vehicle parking availability, the system comprising:

a hardware processor configured to:

receive, from a device, an indication of a transportation-behavior change associated with a first user, wherein the indication of the transportation-behavior change specifies a change from a first transportation behavior to a second transportation behavior at a first location;

identify, using records of parking spaces stored in a database, an available parking space based on the received indication of the transportation-behavior change, wherein identifying the available parking space comprises:

identifying one or more candidate parking spaces based on the received indication of the transportation-behavior change;

calculating a set of second probabilities, each probability of the set of second probabilities specifying a confidence level that the first location of the transportation-behavior change is located at a respective candidate parking space;

determine one or more navigation users having a destination proximate to the available parking space;

calculate, for a given navigation user, a set of parking-availability probabilities, each one of the set of parking-availability probability representing a likelihood that the given navigation user will obtain a respective candidate parking space;

calculate, for the given navigation user, for each of the candidate parking spaces, a cumulative probability based on a respective one from the set of second probabilities, and on the respective one of the set of parking-availability probabilities associated with the given navigation user, thereby forming a set of cumulative probabilities associated with the candidate parking spaces and the given navigation user, wherein:

the cumulative probability, for a given one candidate parking space, represents a likelihood that the given one candidate parking space is available and a respective navigation user will obtain the given one candidate parking space;

transmit, to at least one of the navigation users, a notification of the available parking space according to the calculated cumulative probabilities.

7. The system of claim 6, wherein the system is configured to calculate the set of second probabilities associated with the candidate parking spaces based on at least one of a set of factors including a size of a parking lot, a distance of a parking space to the location of the transportation-behavior change, a type of parking, a number of times other users have been associated with the parking space, and a number of previously-recorded locations have been associated with the respective parking space in a prior time period.

8. The system of claim 6, wherein the processor configured to determine one or more navigation users having a destination proximate to the available parking space is further configured to:

calculate, for each navigation user, a parking-availability probability that the respective navigation user will obtain the available parking space;

select a subset of the navigation users having an associated parking-availability probability of obtaining the available parking space that exceeds a first threshold value; and transmit the notification to the selected subset.

9. The system of claim 6, wherein the processor configured to determine one or more navigation users having a destination proximate to the available parking space is further configured to:

calculate, for each navigation user, a parking-availability probability that the respective navigation user will obtain the available parking space;

rank the navigation users according to the associated parking-availability probability of obtaining the available parking space; and transmit the notification to a subset of the ranked navigation users.

10. A computer-implemented method for determining vehicle parking availability, comprising:

receiving, from a device, an indication of a transportation-behavior change associated with a user of the device, wherein the indication of the transportation-behavior change specifies a change from a first transportation behavior of the user to a second transportation behavior of the user at a location;

determining the location of the transportation-behavior change to be within a predetermined area threshold of at least one of previous device-associated locations;

responsive to determining that the location is out of the predetermined area threshold, adjusting the location of the transportation-behavior change with the at least one of previous device-associated locations;

identifying one or more candidate parking spaces based on the location of the transportation-behavior change associated with the user of the device;

calculating a set of probabilities associated with the candidate parking spaces, each probability of the set of probabilities specifying a confidence level that the location of the transportation-behavior change is located at a respective candidate parking space;

determining an available parking space associated with the transportation-behavior change based on a calculated maximal probability of the set of probabilities; and transmitting a notification of the available parking space to other devices.

11. The method of claim 10, wherein identifying the one or more candidate parking spaces comprises:

determining a map section associated with the location of the transportation-behavior change; and identifying the candidate parking spaces contained within the map section.

12. The method of claim 10, wherein the transportation-behavior change is determined based on a behavior pattern of a plurality of predetermined behavior patterns.

13. The method of claim 10, wherein the transportation-behavior change specifies a change from a first transportation behavior of walking to a second transportation behavior of driving.

14. The method of claim 10, wherein calculating the set of probabilities associated with the candidate parking spaces is based on at least one of a set of factors including a size of a parking lot, a distance of a parking space to the location of the transportation-behavior change, a type of parking, a number of times other users have been associated with the parking space, and a number of previously-recorded locations have been associated with the respective parking space in a prior time period.

15. The method of claim 10, wherein the transmitting a notification of the available parking space to the other devices comprises:

identifying a set of the other devices having routes with a destination proximate to the location of the available parking space; and transmitting the notification to the identified other devices.

* * * * *